United States Patent [19]

Komura

[11] Patent Number: 4,614,993

[45] Date of Patent: Sep. 30, 1986

[54] OPERATION CONTROL APPARATUS IN A COMBUSTION DEVICE

[75] Inventor: Masahiko Komura, Aichi, Japan

[73] Assignee: Rinnai Corporation, Aichi, Japan

[21] Appl. No.: 785,119

[22] Filed: Oct. 7, 1985

[30] Foreign Application Priority Data

Nov. 21, 1984 [JP] Japan ..... 59-244336

[51] Int. Cl.[4] ..... F23Q 3/00; F23N 5/00

[52] U.S. Cl. ..... 361/257; 431/12; 431/67; 431/73

[58] Field of Search ..... 361/253, 254, 255, 256, 361/257; 431/12, 28, 67, 71, 73, 86

[56] References Cited

U.S. PATENT DOCUMENTS

| | | | |
|---|---|---|---|
| 3,947,220 | 3/1976 | Dietz | 361/257 X |
| 4,034,270 | 7/1977 | Matthews | 431/67 X |
| 4,194,875 | 3/1980 | Hewitt | 431/73 |

*Primary Examiner*—Michael L. Gellner
*Assistant Examiner*—Douglas S. Lee
*Attorney, Agent, or Firm*—Nilsson, Robbins, Dalgarn, Berliner, Carson & Wurst

[57] ABSTRACT

An operation control apparatus, in a combustion device, comprising an operation member (4) selectively settable at a stop position (A), an ignition position (B) or an open position (C); an electric member (10) and/or (15) which is energized by an electric power source (20) when the operation member is set in its ignition position; and a limited time operation circuit for affecting the operation of the electric member (10 and/or 15), either by itself energizing the electric member or by enabling the electric member to be energized by the power source (20), for a predetermined period of time. In the apparatus disclosed, the limited time operation circuit is inoperative for affecting the operation of the electric member (10 and/or 15) while the operation member (4) is set in its ignition position (B) and the electric member is energized by the power source (20). This circuit commences to affect the operation of the electric member and thereafter continues so to do for a set period of time upon subsequent setting of the operation member in its open position (C), and in this way a longer period in which this circuit is effective is obtained as compared with apparatus in which such a current commences to run at an earlier stage.

11 Claims, 39 Drawing Figures

OPERATION CONTROL APPARATUS IN A COMBUSTION DEVICE

PRIORITY CLAIM

This application claims priority under 35 USC 114 from Japanese Patent Application Serial No. 59-244336, filed Nov. 21, 1984.

FIELD OF THE INVENTION

The field of art to which the invention pertains is the field of gas water heaters.

BACKGROUND AND SUMMARY OF THE INVENTION

This invention relates to operation control apparatus in a combustion device such as a gas water heater having an electric member such as an electromagnetic safety valve or an ignition plug.

There has been hitherto known operation control apparatus, in a combustion device, comprising (a) an operation member which is movable to be changed over between a starting end stop position, an intermediate open position, and a final end ignition position; (b) an electric member comprising for example an electromagnetic safety valve which is to be energized for operation and be continued in operation even after the operation member is returned to the intermediate open position; and (c) a limited time operation circuit for operating the electromagnetic safety valve so that if the operation member is moved from the stop position through the open position to the ignition position, the limited time operation circuit starts to run and burner ignition can take place. Thereby the electromagnetic safety valve is kept in its open condition by the continuing operation of the limited time operation circuit for a predetermined period from the time when the operation member is returned to the open position, to the time when a predetermined electromotive force is generated from a thermo-couple heated by the ignited burner and thereby the electromagnetic safety valve is kept in its open condition. There is an inconvenience, however, in that the limited time operation circuit is started in operation before ignition actually occurs, and consequently if there remains a large amount of air in a gas supply pipe at the time of attempted ignition of the burner, there is the possibility that, before air purging is completely effected and the burner can be ignited, the limited time operation circuit will have run its set time and ceased its operation, so that the electromagnetic safety valve is closed.

According to the present invention, there is provided an operation control apparatus, in a combination device, comprising an operation member selectively settable at a stop position, an ignition position or an open position; an electric member which is energised by an electric power source when the operation member is set in its ignition position; and a limited time operation circuit for affecting the operation of the electric member, either by itself energising the electric member or by enabling the electric member to be energised by the power source, for a predetermined period of time, the limited time operation circuit being inoperative for affecting the operation of the electric member while the operation member is set in its ignition position and the electric member is energised by the power source, and commencing to affect the operation of the electric member and thereafter continuing so to do for a set period of time upon subsequent setting of the operation member in its open position. Since it is so arranged that (a) when the operation member is at the ignition position, the electric member (such as an electromagnetic safety valve) is directly energised for operation by the electric power source and the limited time operation circuit is restrained from running, and (b) it is when the operation member is returned to the open position that the limited time operation circuit is started to run, it is only at the time of return movement of the operation member to the open position that the electric member commences to be held in its energised state by, or as a result of the effect of, the operation circuit and therefore it is from this moment that the electric member is operated reliably for a predetermined period of time. In this way a longer period is obtained for effecting air purging as compared with conventional apparatus in which the operation circuit commences to run at an earlier stage. This is achieved without including a purge time necessary for obtaining air purging in the set period of time of the operation circuit, as required in the eonventional apparatus, so that the set period of time of the operation circuit can be shortened as compared with the conventional apparatus.

DETAILED DESCRIPTION

Figure 1:
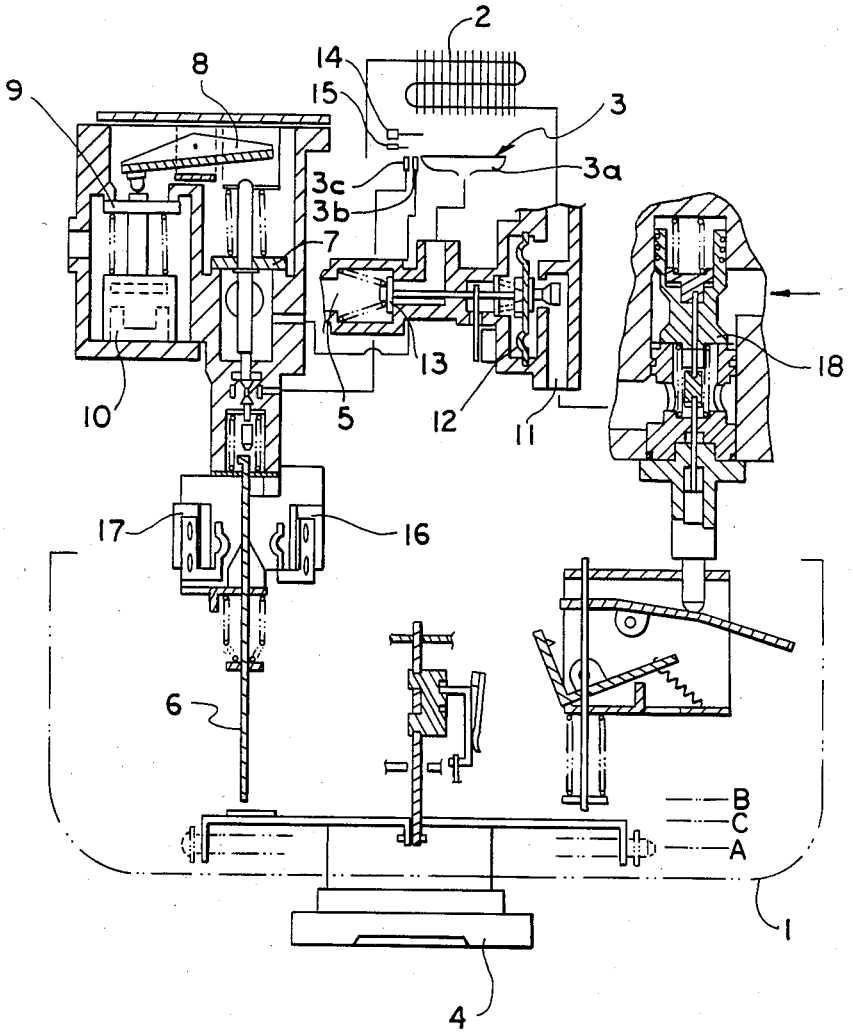
FIG. 1 is a sectional top plan view of a gas water heater, with some components shown diagrammatically.

Referring first to FIG. 1, numeral 1 denotes a main body of a water heater, which constitutes a combustion device. The main body 1 is provided therein with a heat exchanger 2 and a burner unit 3 facing the heat exchanger. On a front surface of the body 1 there is an operation member 4 which is a push-push type push button.

The operation member 4 is such that upon first time pushing, the member 4 is moved rearwards from a starting end stopping position A as illustrated to a final end ignition position B. If released from the pushing at the ignition position B, the member 4 returns to an intermediate open position C. Upon a second time pushing, the member 4 is slightly moved rearwards from the open position C, and if the member is then released from this pushing, it returns to the original starting end stop position A.

The burner unit 3 comprises a main burner 3*a*, a permanent burner 3*b* on one side thereof, and an ignition burner 3*c* on the same side thereof. A gas passage 5 connected to the burner unit 3 is provided with a gas valve 7 and an electromagnetic safety valve 9 constituting an electric member. The gas valve 7 is arranged to be pushed to open through an operation rod 6 when the operation member 4 is moved rearwards to the ignition position B. The electromagnetic safety valve 9 is arranged to be pushed to open through an intermediate lever 8 when the gas valve 7 is opened, and is provided with an operation solenoid 10 for keeping the valve 9 in its open condition. Additionally, a water pressure sensitive valve 13 arranged to be opened at the time of water supply in conjunction with a water governor 12 interposed in a water passage 11 connected to the heat exchanger 2 is interposed in the gas passage 5 downstream (with respect to gas flow) of the valves 7 and 9. The operation solenoid 10 has a thermo-couple 14, which is disposed above the burner unit 2, connected to both ends thereof, and there is also above the burner unit 10 an ignition plug 15 (constituting another electric member) for ignition.

Behind the operation member 4 there is a hold switch 16 that is pushed to be changed over by the operation rod 6 when the operation member 4 is moving to the ignition position B, and an ignition switch 17 that is pushed to close by the operation rod 6 when the operation member 4 reaches the ignition position B.

Numeral 18 denotes a water valve interposed in the water passage 11, and which is pushed to open if the operation member 4 is returned from the ignition position B to the open position C.

Figure 2:
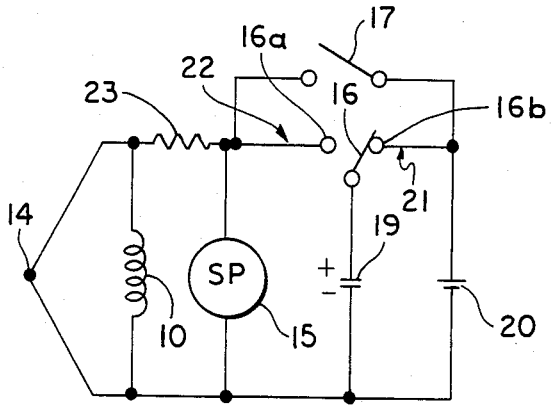
FIG. 2 is a circuit diagram of an important portion of the heater of FIG. 1.

FIG. 2 shows a first embodying example of a control circuit.

In this example, the electric members, that is, the operation solenoid 10 and the ignition plug 15 which are connected together in parallel with one another are connected through the ignition switch 17 to an electric power source 20, and are interposed in a discharging circuit 22 of a capacitor 19 which is previously charged by the electric power source 20. To this end, the capacitor 19 is connected, (a) through an ordinarily closed stationary contact 16*b* of the hold switch 16, to the electric power source 20 in a charging circuit 21 for the capacitor 19, and (b) through an ordinarily open stationary contact 16*a* of the hold switch 16, to the electric members 10, 15 in the discharging circuit 22 for the capacitor 19. Thus the discharging circuit 22 is arranged to serve as a limited time operation circuit for the electric members 10, 15 and, since the hold switch 16 operates in conjunction with the ignition switch 17, this limited time operation circuit is controlled in operation in dependence upon opening and closing of the ignition switch 17.

If, thus, in conjunction with moving rearwards the operation member 4 from the starting end stop position A to the ignition position B, the hold switch 16 is changed over to the ordinarily open side and thereafter the ignition switch 17 is closed, the operation solenoid 10 and the ignition plug 15 are connected to the electric power source 20 through the ignition switch 17 and are thereby directly energised for operation, and at the same time the capacitor 19 is applied with the electric voltage of the electric power source 20 and as a result is prevented from discharging and thus the limited time operation circuit is restrained from being set to run. If, thereafter, the operation member 4 is moved to return from the ignition position B to the open position C so that the ignition switch 17 is open but the hold switch 16 remains changed over to the ordinarily open side, then the capacitor 19 has no longer applied to it the electric voltage of the electric power source 20 and therefore the capacitor 19 starts to discharge, and thus the limited time operation circuit starts to run. The discharging current flows through the operation solenoid 10 and the ignition plug 15 for a predetermined period of time, during which period the electromagnetic safety valve 9 is kept in its open condition and sparking over the permanent burner 3*b* and the ignition burner 3*c* can be continued.

In this example, the electric power source 20 is a storage battery and a resistance 23 is interposed between the operation solenoid 10 and the ignition plug 15 so that when the battery electromotive force becomes so less than a predetermined value that no spark is generated, the electric current flowing through the operation solenoid 10 becomes below the holding current thereof and consequently the electromagnetic safety valve 9 cannot be kept in its open condition.

Figure 3:
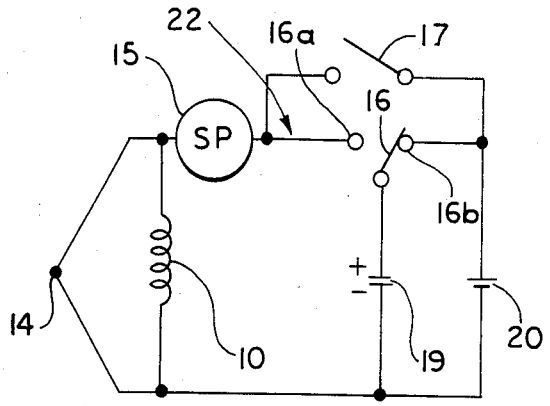
FIGS. 3–39 are circuit diagrams of further examples.

FIG. 3 shows a second embodying example of a control circuit.

This example is not especially different from the first example shown in FIG. 2, except that the operation solenoid 10 and the ignition plug 15 are connected together in series with one another.

Figure 4:
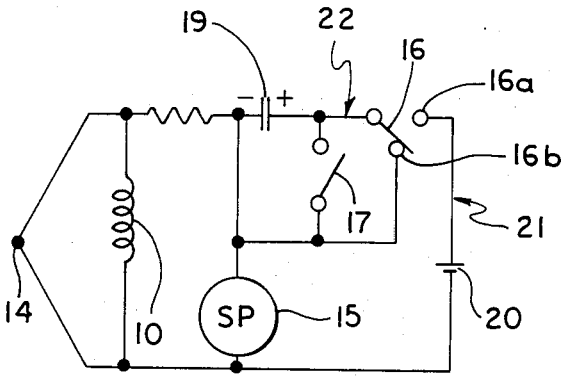

FIG. 4 shows a third embodying example of a control circuit.

In this example, the electric members, that is, the operation solenoid 10 and the ignition plug 15, are connected together in parallel with one another; can be connected to the electric power source 20 through the ignition switch 17; and are interposed in the charging circuit 21 for the capacitor 19, the capacitor 19 is connected through the ordinarily open stationary contact 16*a* of the hold switch 16 to the electric power source 20 with the electric members 10, 15 being each in series with the capacitor.

In this control circuit, the capacitor 19 is short-circuited, through the ordinarily closed stationary contact 16*b* of the hold switch 16, to form the discharging circuit 22 for the capacitor 19. In this example it is the charging circuit 21 that serves as a limited time operation circuit for the electric operating members 10, 15, this charging circuit being controlled by opening and closing of the ignition switch 17.

In operation when, in conjunction with moving the operation member 4 rearwards from the stop position A to the ignition position B, the hold switch 16 is changed over to the ordinarily open side and thereafter the ignition switch 17 is closed, the operation solenoid 10 and the ignition plug 15 are connected to the electric power source 20 through the ignition switch 17 so to be directly energised for operation, and at the same time the capacitor 19 is short-circuited by the ignition switch 17 so that charging of the capacitor is restrained and therefore the limited time operation circuit (the charging circuit 21) is kept inoperative. If, then, the operation member 4 is moved to return to the open position C, the ignition switch 17 is opened, the hold switch 16 remains changed over to its ordinarily open side, and the capacitor 19 is released from the short-circuit condition thereof and is allowed to start being charged. Accordingly the limited time operation circuit (the charging circuit 21) starts to run, the charging current flowing through the operation solenoid 10 and the ignition plug 15 for a predetermined period of time (that is, until the capacitor 19 which is in series with the solenoid 10 and the ignition plug 15 becomes fully charged) so that during this period the electromagnetic safety valve 9 can be kept in its open condition and the sparking over the permanent burner 3*b* and the ignition burner 3*c* can be continued. These functions cease when the capacitor 19 becomes fully charged.

Figure 5:
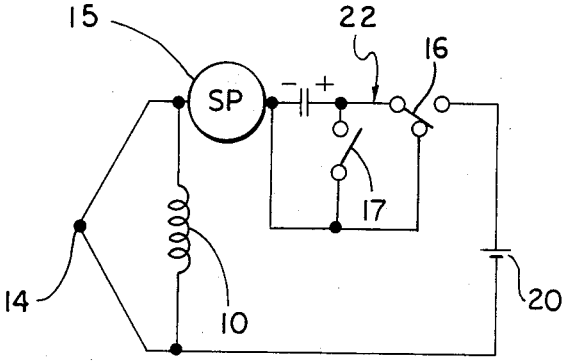

FIG. 5 shows a further embodying example of a control circuit that is not especially different from the example shown in FIG. 4, except that the operation solenoid 10 and the ignition plug 15 are connected together in series with one another.

Figure 6:
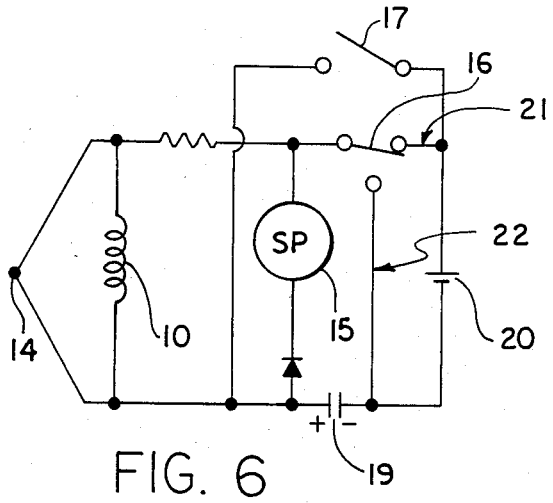

FIG. 6 shows a fifth embodying example of a control circuit which is not especially different from the example shown in FIG. 2, except that the operation solenoid 10 is arranged to be energised not only while the capacitor 19 is discharging but also when the capacitor 19 is being charged. In this regard, with switch 16 at its ordinarily closed side and switch 17 open the solenoid 10 is connected for being energised by the power source 20 and the capacitor 19 is connected for being charged. On the other hand, the ignition plug 15 is in a circuit that includes a rectifier such that the ignition plug 15 is only connected for energisation when the hold switch 16 is changed over to its ordinarily open side. Upon change over of the switch 16 to its ordinarily open side, and closing of the switch 17, the solenoid 10 remains connected for energisation by the power source, in a circuit that includes the capacitor 19 which is thus prevented from discharging. The ignition plug 15 is also energised. When the switch 17 opens, the solenoid and the ignition plug are cut off from the power source 20 and the capacitor 19 commences to discharge to energise the solenoid and the ignition plug.

Figure 7:
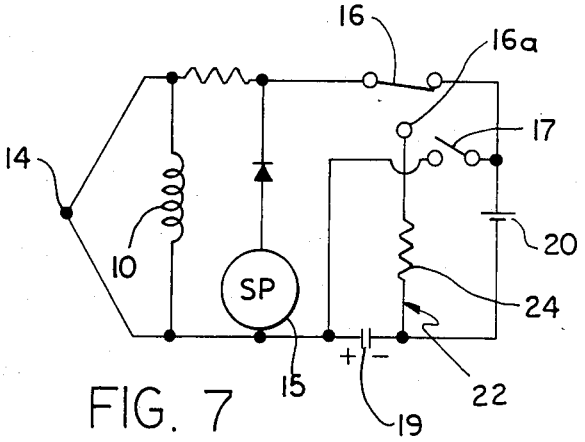

FIG. 7 shows a sixth embodying example of the control circuit. This example is not especially different from the example shown in FIG. 6, except that a resistance 24 is interposed between the ordinarily open stationary contact 16*a* of the hold switch 16 and the negative side of the capacitor 19, which is a chemical capacitor.

Figure 8:
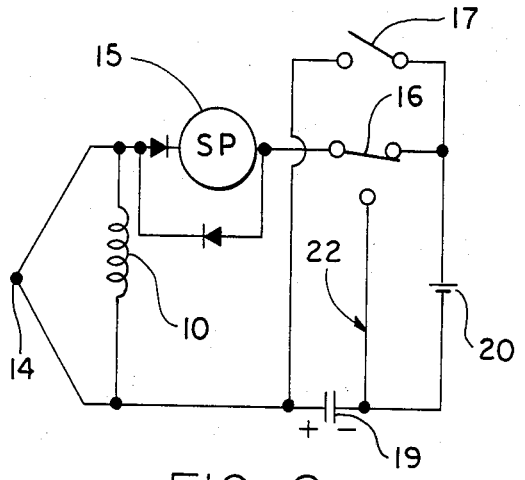

FIG. 8 shows a seventh embodying example of a control circuit not especially different from the example shown in FIG. 6, except that the operation solenoid 10 and the ignition plug 15 are connected together in series with one another.

Figure 9:
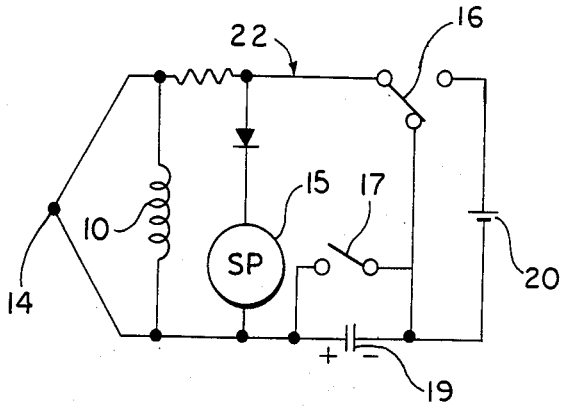

FIG. 9 shows an eighth embodying example of a control circuit. This example is not especially different from the example shown in FIG. 4 save that the ignition plug 16 has a rectifier associated with it such that if the operating member is moved to its stop position so that the switch 16 moves to its ordinarily open side and the ignition switch opens, the then-discharging capacitor 19 energises the solenoid 10 but not the ignition plug 15. In the example of FIG. 4 under this condition both the solenoid 10 and the ignition plug 15 are energised.

Figure 10:
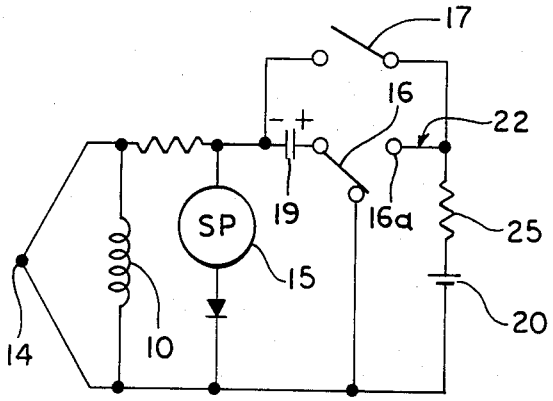
Figure 11:
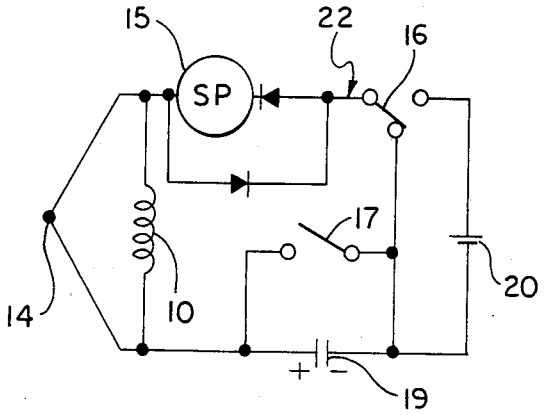

FIG. 10 shows a ninth embodying example of a control circuit. This example is not especially different from the example shown in FIG. 9, except that a connecting point between the ordinarily open stationary contact 16*a* of the hold switch 16 and the ignition switch 17 is connected to the positive side of the electric power source 20 through a resistance 25, and the capacitor 19 is changed in position.

Figure 12:
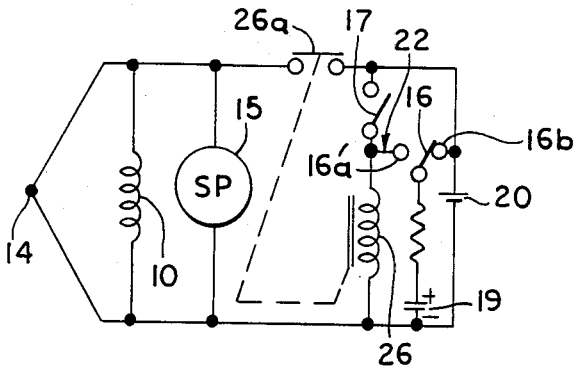

FIG. 12 shows an eleventh embodying example of a control circuit. In this example, the operation solenoid 10 and the ignition plug 15 are connected to the electric power source 20 via contacts 26*a* of a relay 26 that is energised to close the contacts 16*a* either by its connection to the power source 20, or by its connection to receive discharge current from the capacitor 19. Thus, when the operation member is at its stop position the capacitor 19 is charged by the power source 20 (switches 16 and 17 positioned as shown in FIG. 12). Upon changeover of the switch 16 and closure of the switch 17 (operation member moved to its ignition position) the power source 20 is connected first to energise the relay 26 to close the contact 26*a*, and thereafter in addition to energise the solenoid 10 and the ignition plug 15. When the operating member is moved to its open position so that the switch 17 opens, discharge from the capacitor 19 maintains the relay 26 energised and hence the power source 20 continues to energise the solenoid 10 and plug 15 until the discharging current ceases to flow and the contacts 26*a* open. In this example therefore the limited time operation circuit that is constituted by the capacitor 19 when connected to energise the relay 26 serves to enable the solenoid 10 and the ignition plug 15 to continue to be energised by the power source 20 for a set time.

Figure 13:
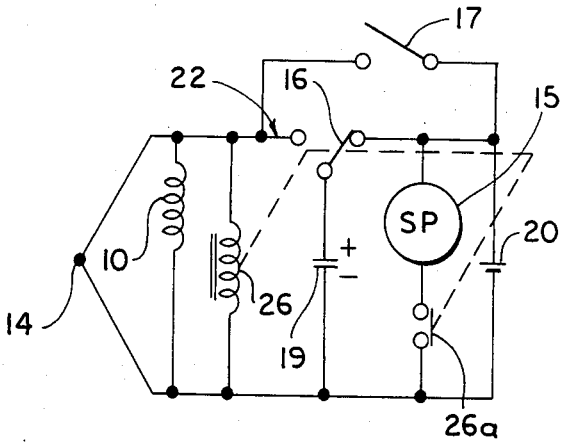
Figure 14:
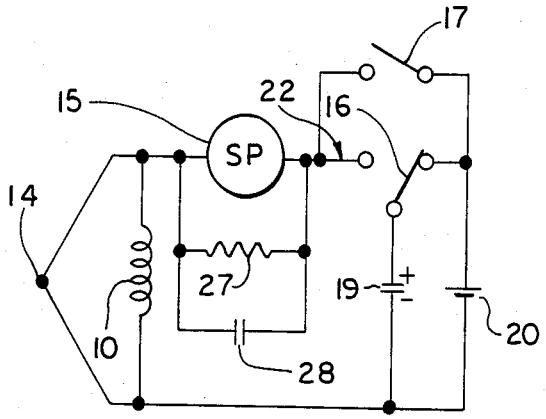
Figure 15:
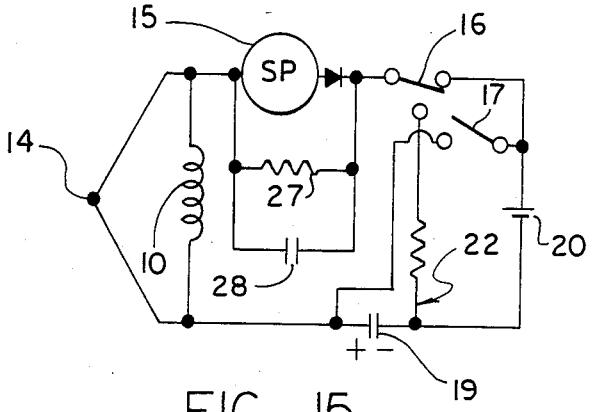
Figure 16:
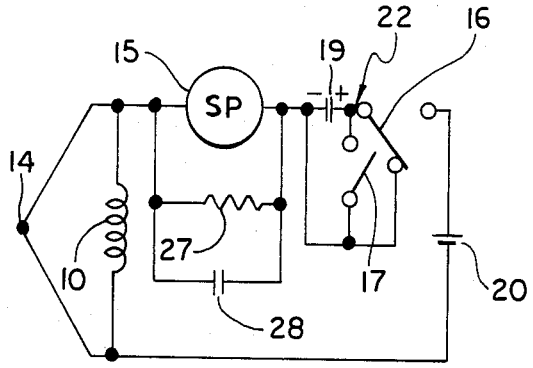
Figure 17:
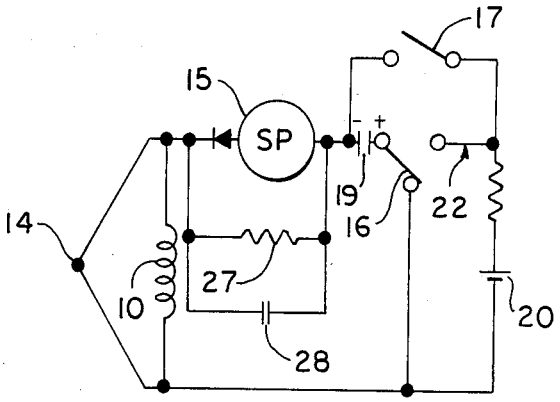
Figure 18:
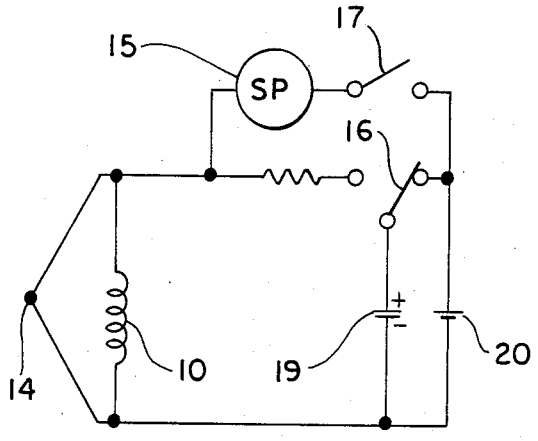
Figure 19:
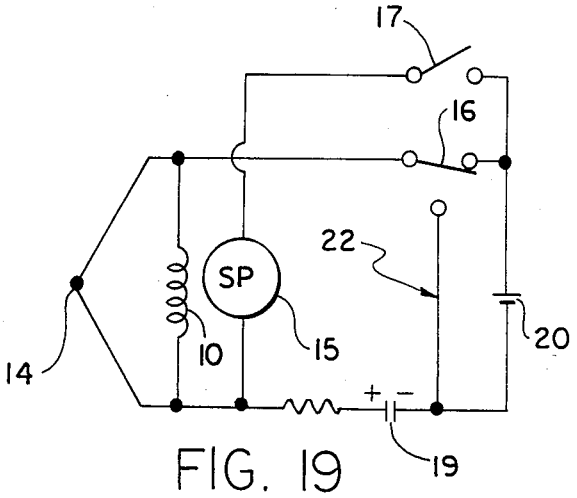
Figure 20:
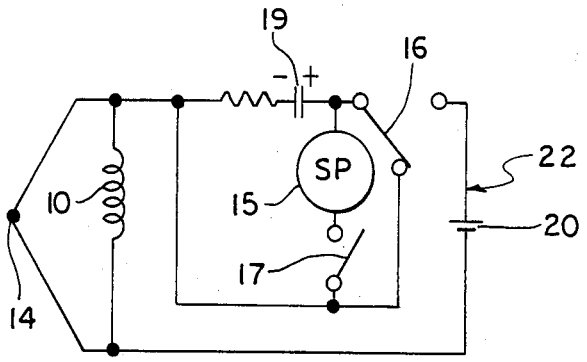
Figure 21:
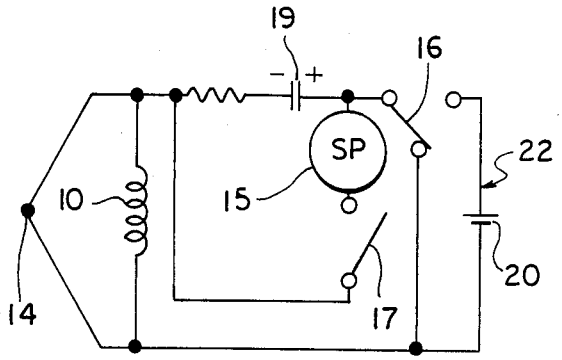
Figure 22:
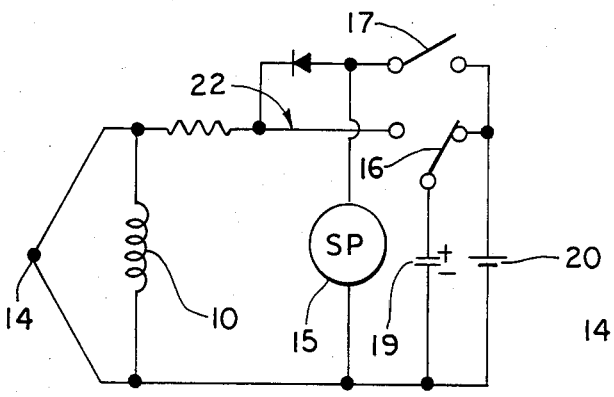
Figure 23:
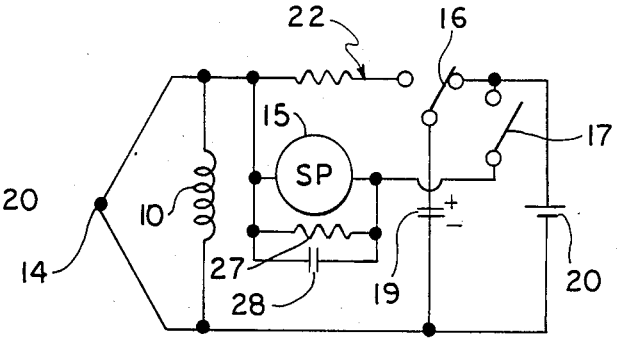
Figure 24:
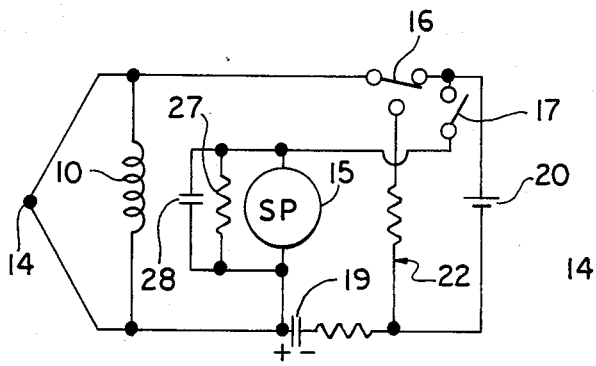
Figure 25:
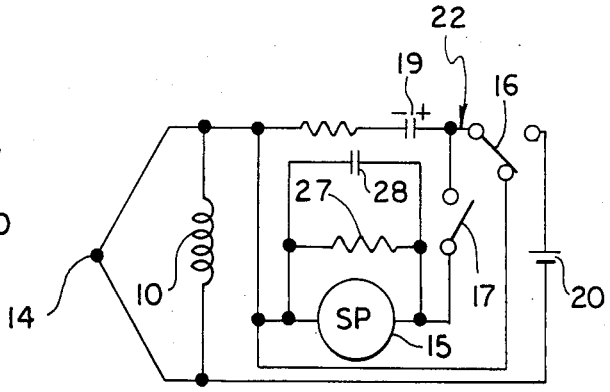
Figure 26:
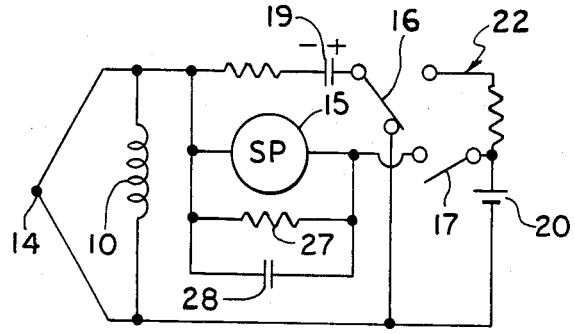
Figure 27:
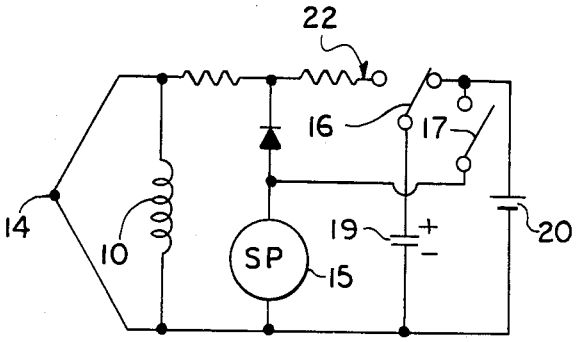
Figure 28:
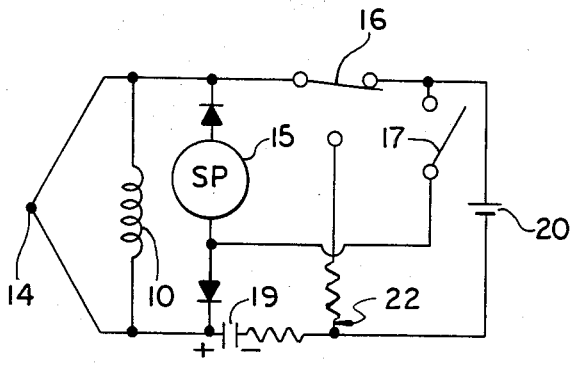
Figure 29:
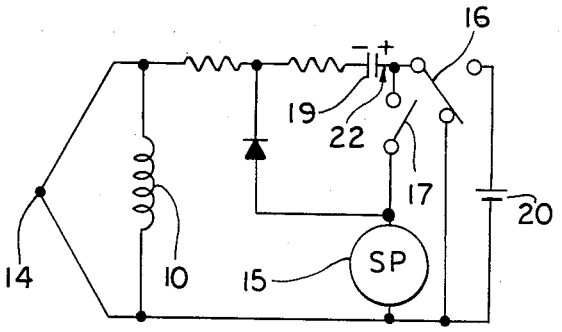
Figure 30:
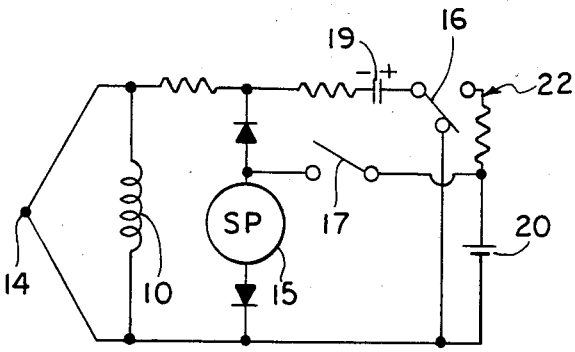
Figure 31:
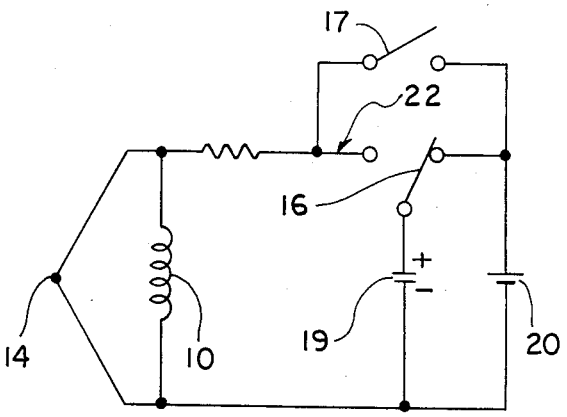
Figure 32:
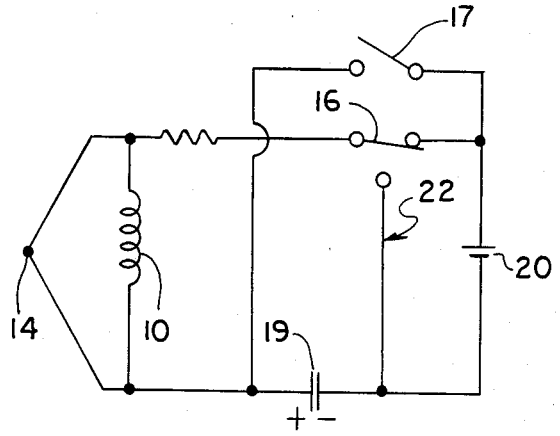
Figure 33:
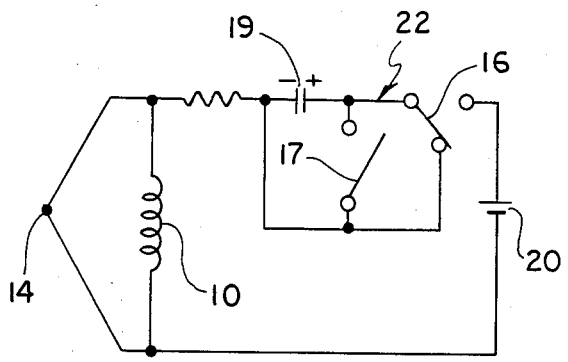
Figure 34:
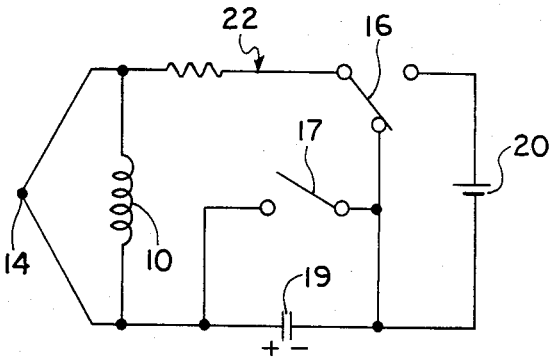
Figure 35:
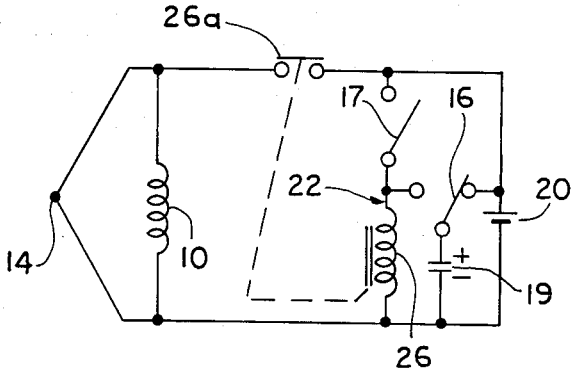
Figure 36:
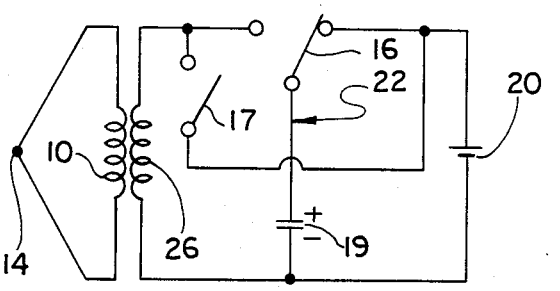
Figure 37:
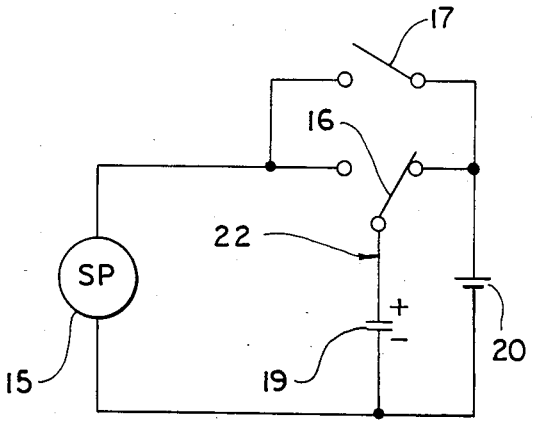
Figure 38:
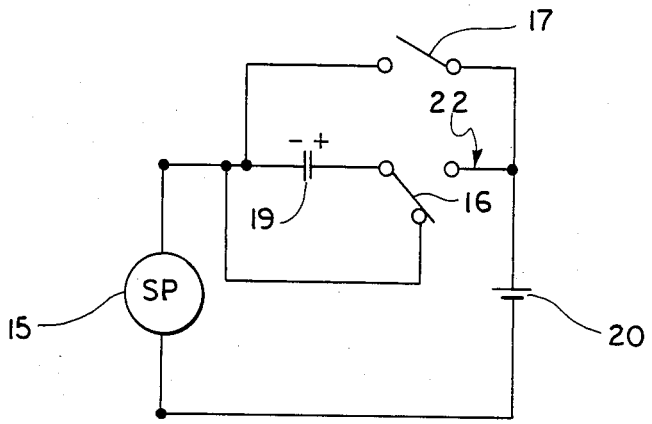

FIG. 13 shows a twelfth embodying example of a control circuit which is a modification of the example shown in FIG. 12 and is not especially different in operation therefrom save that in this example during operation of the limited time operating circuit the solenoid 10 is energised by the discharging current of the capacitor 19 whereas the ignition plug 15 is energised by the power source 20, this being enabled by the discharging circuit energising a relay 26 to hold relay contacts 26*a* closed.

FIGS. 14 to 17 show thirteenth to sixteenth embodying examples of the control circuits which are not especially different from the examples shown in FIGS. 3, 8, 5 and 11 respectively, except that in each case the ignition plug 15 is provided with a smoothing circuit comprising a resistance 27 and a capacitor 28.

FIGS. 18 to 30 show seventeenth to twentieth embodying examples of control circuits that are not especially different from foregoing examples, except that they are for use with an ignition plug that is a piezoelectric operated one (not shown).

The examples shown in FIGS. 6, 7, 8, 9, 10, 11, 15, 17, 19, 21, 24, 26, 28, 29, 30, 31 and 34 are especially advantageous as described below. Even after the operation member 4 is returned to the original stop position A from the open position B by the second time pushing thereof and the subsequent release from the pushing thereof and thereby the burners 3*a*, 3*b*, 3*c* are extinguished, the thermo-couple 14 is liable to be still heated by a remaining or residual heat and consequently the predetermined electromotive force thereof is continued to be generated for a certain period until the remaining heat becomes small, and thereby the operation solenoid 10 is continuously supplied with the holding current and during this period the electromagnetic safety valve 9 is kept in its open condition. For eliminating this inconvenience, in the examples just listed, it is arranged that, when the operation member 4 is returned to the stop position A, an electric current negating the holding current is supplied by the electric power source 20 and thereby the electromagnetic safety valve 9 is closed rapidly.

Figure 39:
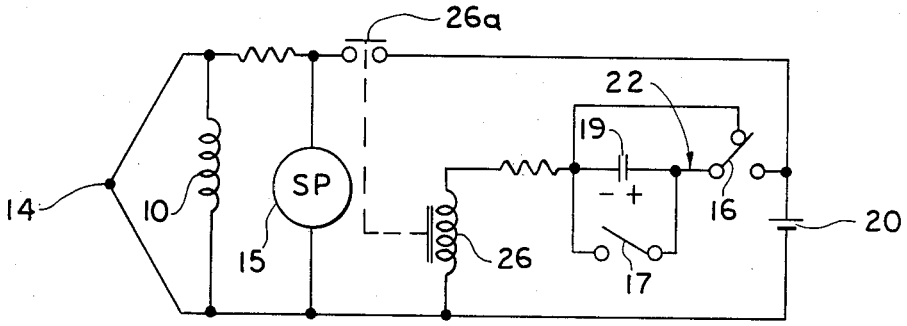

FIG. 39 shows a thirty eighth embodying example of a control circuit which is similar to the example shown in FIG. 12 but is different therefrom in that the limited time operation circuit is composed of the charging circuit of the capacitor 19. The solenoid 10 and ignition plug 15 are connected to the power source 20 via contacts 26*a* of a relay 26 which is energised by the power source 20 to close the contacts 26*a* when the hold switch 16 changes over. With the ignition switch 17 closed the capacitor 19 is short-circuited. When the ignition switch 17 opens, with the switch 16 remaining changed-over, charging current is supplied by the power source 20 to the capacitor 19 and this current serves also to maintain the relay 26 energised, the contacts 26*a* closed, and the solenoid 10 and plug 15 energised by the power source until the capacitor 19 is fully charged.

Operation is as follows:

If the operation member 4 is applied with the first time pushing operation and the releasing operation subsequent thereto, the gas valves including the electromagnetic safety valve 9 are opened to open the gas passage 5, the burner unit 3 is ignited by the ignition plug, and the heat exchanger 2 is supplied with water, and thus there is obtained a hot water discharge.

During this operation, the hold switch 17 is changed over at the time when the operation member 4 is moved through the open position C in the course of moving thereof from the stop position A to the ignition position B, but until the time at which the operation member 4 is moved to return from the ignition position B towards the open position C, the capacitor 19 has continuously applied to it the electric voltage of the electric power source 20, or is short-circuited, and is thereby held in a steady state and thus the limited time operation circuit is restrained from running.

On returning of the operation member 4 to the open position C, the limited time operation circuit is allowed to start running, and thereby the operation solenoid 10 and the ignition plug 15 are maintained energised for operation for a predetermined period of time. In this way, even if, when the operation number 4 is at the ignition position B and the operation solenoid 10 and the ignition plug 15 are energised for operation by the electric power source 20, air purging is not fully completed and the burner unit 3 does not ignite, the opportunity remains for the burner unit 3 thereafter to be ignited reliably during the predetermined period of time the limited time operation circuit is running.

Since in the present apparatus it is so arranged that (a) when the operation member is at the ignition position, the electric member (such as the electromagnetic safety valve) is directly energised for operation by the electric power source and the limited time operation circuit is restrained from running, and (b) it is when the operation member is returned to the open position that the limited time operation circuit is started to run, it is only at the time of return movement of the operation member to the open position that the electric member commences to be held in its energised state by, or as a result of the effect of, the operation circuit and therefore it is from this moment that the electric member is operated reliably for a predetermined period of time. In this way a longer period is obtained for effecting air purging as compared with conventional apparatus in which the operation circuit commences to run at an earlier stage. This is achieved without including a purge time necessary for obtaining air purging in the set period of time of the operation circuit, as required in conventional apparatus, so that the set period of time of the operation circuit can be shortened as compared with the conventional apparatus.

I claim:

1. An operation control apparatus, in a combination device, comprising an operation member selectively settable at a stop position, an ignition position or an open position; an electric member which is energised by an electric power source when the operation member is set in its ignition position; and a limited time operation circuit for affecting the operation of the electric member, either by itself energising the electric member or by enabling the electric member to be energised by the power source, for a predetermined period of time; the limited time operation circuit being inoperative for affecting the operation of the electric member while the operation member is set in its ignition position and the electric member is energised by the power source, and commencing to affect the operation of the electric member and thereafter continuing so to do for a set period of time upon subsequent setting of the operation member in its open position.

2. An operation control apparatus as claimed in claim 1, wherein the electric member is connected to the electric power source as a result of closure of an ignition switch that is closed when the operation member is set in its ignition position; and wherein the limited time operation circuit is an electrical discharging circuit of a capacitive means that is connected to be charged by the electric power source, or to discharge through the discharging circuit, in dependence upon closing and opening of the ignition switch, the capacitative means being prevented from discharging when the ignition switch is closed.

3. An operation control apparatus as claimed in claim 2, wherein a hold switch operated by the operation member in conjunction with the ignition switch is set in a first position to put the capacitive means out-of-circuit with the electric member and in-circuit with the power source so as to be charged thereby when the operation member is in its stop position, the ignition switch being open; and is set in a second position to put the capacitive means in-circuit with the electric member when the operation member is in its ignition position and the ignition switch is closed so that the capacitive means remains in-circuit with the power source and is thereby prevented from discharging; and wherein the ignition switch is open and the hold switch remains in its second position when the operation member is in its open position whereby the capacitive means is taken out-of-circuit with the electric member for discharging to energise the electric member.

4. An operation control apparatus as claimed in claim 1, 2 or 3, wherein the electric member is one of two electric members that are energised together.

5. An operation control apparatus as claimed in claim 2, wherein a hold switch operated by the operation member in conjunction with the ignition circuit is set in a first position to put the capacitive means and the electric member in-circuit with the power source, for charging the capacitive means and energising the electric member, when the operation member is in its stop position, the ignition switch being open; and is set in a second position when the operation member is in its ignition position and the ignition switch is closed, in which the operation member is connected for energising by the power source in a circuit which includes the capacitive means which is thus prevented from discharging; and wherein the ignition switch is open and the hold switch remains in its second position whereby the capacitive means is taken out-ofcircuit with the power source but remains in-circuit with the electric member for discharging to energise the electric member.

6. An operation control apparatus as claimed in claim 5, wherein the electric member is a first electric member, and wherein there is a second electric member connected with the first electric member in a circuit that includes rectifier means such that this second electric member is only connected for energising when the hold switch is in its second position.

7. An operation control apparatus as claimed in claim 2, wherein a hold switch operated by the operation member in conjunction with the ignition switch is set in a first position to put the capacitive means out-of-circuit with the electric member and in-circuit with the power source so as to be charged thereby when the operation member is in its stop position; wherein closure of the ignition switch upon movement of the operation member to its ignition position serves to energise relay means to put the electric member in-circuit with the power source to be energised thereby; and wherein the hold switch is set in a second position when the operation member is moved to its ignition position and remains in this second position upon subsequent movement of the operation member to its open position in which the ignition switch is open; the capacitive means being ineffective on the electric member when the ignition switch is closed, and being effective to energise said relay means by discharging when the ignition switch opens with the hold switch remaining in its second position whereby the power source remains connected to energise the electric member for as long as the discharging capacitive means energises the relay means.

8. An operation control apparatus as claimed in claim 7, wherein the electric member is a first electric member, and wherein there is a second electric member that is connected for energisation solely by the power source in dependence upon opening and closing of contacts of a relay that is energised to close the contacts by the power source when the ignition switch is closed, and by the discharging capacitive means when the ignition switch is open and the hold switch is in its second position.

9. An operation control apparatus as claimed in claim 1, and including an ignition switch that is open when the operation member is in its stop position, is closed when the operation member is in its ignition position, and is open when the operation member is in its open position; and a hold switch operated by the operation member in conjunction with the ignition switch; and wherein the limited time operation circuit is an electrical charging circuit of a capacitive means; the connections via the ignition switch and the hold switch being such that when the operation member is in the stop position the electric member and the capacitive means are out-of-circuit with the power source; in the ignition position of the operation member the electric member is in-circuit with the power source for being energised thereby and the capacitive means is short-circuited; and in the open position of the operation member the electric member and the capacitive means are in circuit with the power source so that the electric member is energised by the power source until the capacitive means becomes fully charged.

10. An operation control apparatus as claimed in claim 9, wherein the electric member is one of two members that are connected to be both energised when the operation member is in its ignition position or in its open position; these two members having rectifier means associated therewith such that in the stop position one only of the two members is connected to be energised by discharge of the capacitive means.

11. An operation control apparatus as claimed in claim 9, wherein in the ignition position of the operation member the electric member is held in-circuit with the power source by relay means energised by the closed ignition switch; and in the open position of the operation member this relay means is maintained energised by the power source until the capacitive means becomes fully charged.

* * * * *